US005929809A

United States Patent [19]

Erlick et al.

[11] Patent Number: 5,929,809

[45] Date of Patent: Jul. 27, 1999

[54] METHOD AND SYSTEM FOR CALIBRATION OF SECTIONALLY ASSEMBLED PHASED ARRAY ANTENNAS

[75] Inventors: John Richard Erlick, Scottsdale; Jonathan Henry Gross, Gilbert, both of Ariz.

[73] Assignee: Motorola, Inc., Schaumburg, Ill.

[21] Appl. No.: 09/056,128

[22] Filed: Apr. 7, 1998

[51] Int. Cl.[6] ..... H01Q 3/24

[52] U.S. Cl. ..... 342/372; 342/174; 342/373

[58] Field of Search ..... 342/174, 360, 342/368, 373, 372

[56] References Cited

U.S. PATENT DOCUMENTS

| | | | |
|---|---|---|---|
| 4,283,725 | 8/1981 | Chisholm | 343/5 W |
| 5,027,127 | 6/1991 | Shnitkin | 342/372 |
| 5,036,333 | 7/1991 | Chapman et al. | 342/370 |
| 5,499,031 | 3/1996 | Bodonyi | 342/174 |
| 5,530,449 | 6/1996 | Wachs et al. | 342/174 |
| 5,644,316 | 7/1997 | Lewis et al. | 342/174 |

*Primary Examiner*—Thomas H. Tarcza
*Assistant Examiner*—Dao L. Phan
*Attorney, Agent, or Firm*—Frank J. Bogacz; Walter W. Nielsen

[57] ABSTRACT

The invention describes a method and system for the calibration of sectionally assembled phased array antennas. When a large, multi-sectioned phased array antenna on board a satellite (10, FIG. 1) is unfolded during deployment, an error in the alignment of a phased array antenna section (25) can cause an error in the pointing angle of the transmit antenna beam (50). A suitable receive antenna (80) receives a signal from the transmit antenna beam (50) which enables a processor unit (95, FIG. 2) to determine the required correction factor. The correction factor is then applied to the beam coefficients which control the beam of the phased array antenna section (25). Subsequent to a first measurment, the correction factor can be updated to minimize the impact of antenna element failures on the resulting antenna pattern.

23 Claims, 3 Drawing Sheets

METHOD AND SYSTEM FOR CALIBRATION OF SECTIONALLY ASSEMBLED PHASED ARRAY ANTENNAS

FIELD OF THE INVENTION

The invention relates generally to antennas and, more particularly, to methods and systems for the calibration of sectionally assembled phased array antennas.

BACKGROUND OF THE INVENTION

In a radio communication system which links multiple subscribers to a central communications node, there is a need to make use of high gain antenna beams in order to connect these subscribers with the central communications node. For substantially wideband multi-user communication systems, the use of high gain antenna beams is necessary in order to provide a positive link margin between the communications node and the plurality of subscribers. This is especially true in a wideband communication satellite system where multiple earth-based subscribers are linked to a communications satellite network through wideband data links. In such a system, very large antennas are required at the communication satellite in order to provide a positive link margin between each earth-based subscriber and the communication satellite.

In a communication satellite, a phased array antenna can be used to create high gain transmit or receive beams. Typically, as more surface area is provided by the phased array antenna, the gain of the transmit or receive antenna beam increases. In a satellite system which requires multiple satellites in orbit about the earth, the use of very large antenna arrays arranged as a rigid structure can be cost prohibitive. Therefore, when large antenna arrays are to be deployed in space, it becomes advantageous to assemble the array in space on a section-by-section basis. The most desirable method of sectionally constructing a large space-based phased array antenna is to launch the satellite with the antenna folded within the payload volume of the launch vehicle and allow the antenna to unfold after deployment of the satellite.

When a multi-sectioned phased array antenna is unfolded, misalignments between adjacent sections can occur. These misalignments cause the portions of the beam generated by each individual section of the array to be less than optimally combined in front of the antenna. The misalignments cause errors which degrade the performance of the communication system in that they reduce the gain of the transmit or receive antenna beam generated by the satellite. If, however, the error in the pointing angle can be discerned, the beam coefficients for the particular misaligned section can be adjusted to enable the antenna beam to point in the correct direction.

Errors in the pointing accuracy of receive or transmit antenna beams can also be caused by the loss of elements which comprise the phased array antenna section. In a receive antenna, the loss of elements can be caused by the failure of receive electronics, such as low noise amplifiers, which are coupled to each antenna element. In a transmit antenna, the loss of elements can be caused by the failure of solid state power amplifiers which are coupled to each transmit antenna element.

Therefore, what is needed are a method and system for remote calibration of sectionally assembled phased array antennas. Such a system would enable the rapid correction of beam pointing errors caused by any misalignment in the unfolded antenna array, or the loss of antenna elements which comprise a particular phased array antenna section.

DESCRIPTION OF THE PREFERRED EMBODIMENTS

A method and system for the calibration of sectionally assembled phased array antennas facilitates the low-cost correction of errors in the pointing angle of a receive or transmit antenna beam created by a misaligned antenna section. Additionally, when an error in the pointing angle of an antenna beam results from the loss of antenna elements which comprise a section, the impact of this degradation can be minimized as well. In both cases, a correction factor can be determined and the beam coefficients of the elements which comprise a misaligned or degraded antenna section can be adjusted to restore performance. If desired, additional measurements can be made at other times during the life of the system in order to update the correction factor. This provides the ability to deploy large, sectionally assembled antenna systems without requiring precise control over the mechanical components which facilitate the unfolding of the antenna sections.

Figure 1:
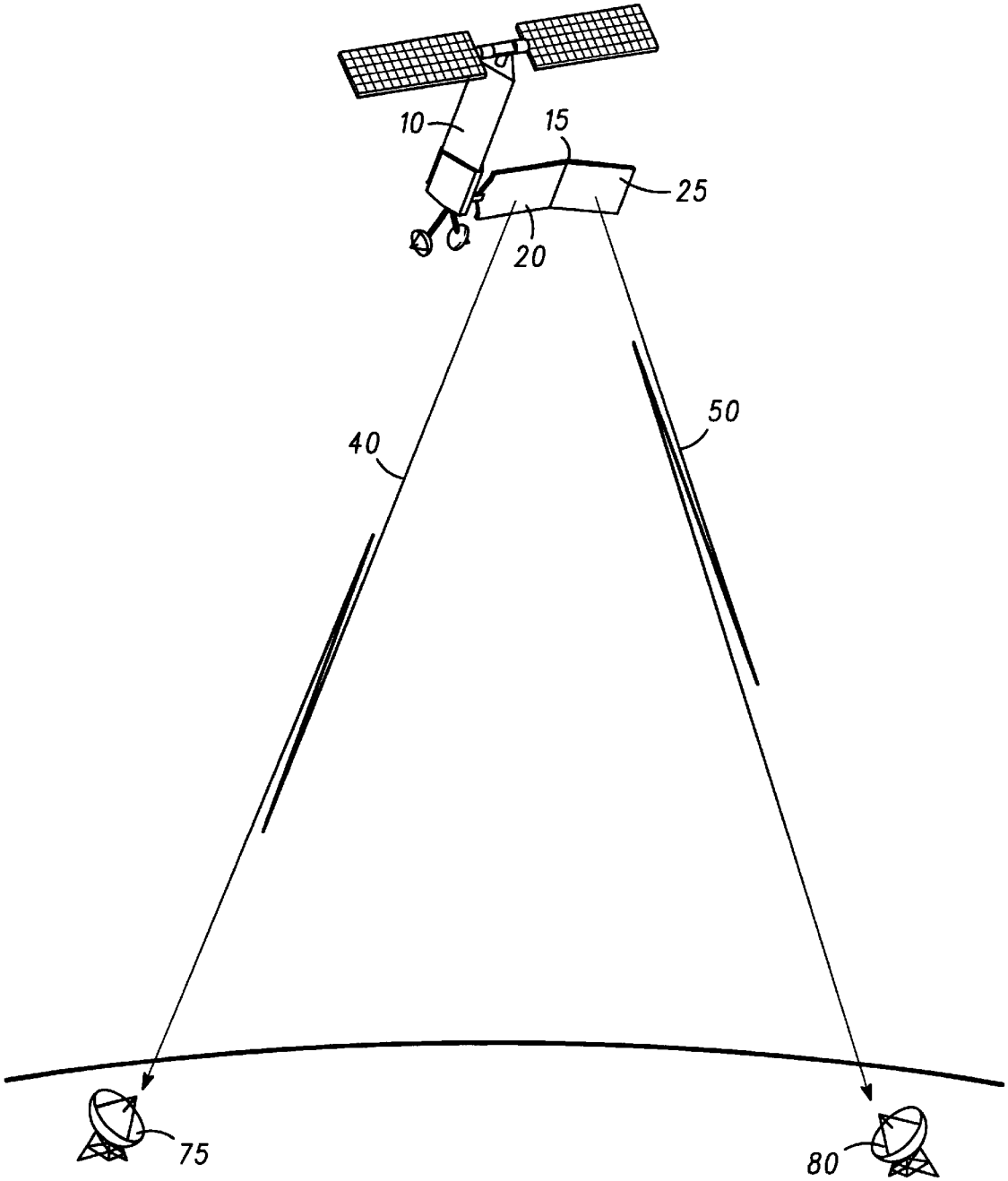
FIG. 1 illustrates the measurement of a satellite antenna pattern using earth-based receive antennas in accordance with a preferred embodiment of the invention.

FIG. 1 illustrates the measurement of a satellite antenna pattern using earth-based receive antennas in accordance with a preferred embodiment of the invention. In FIG. 1, satellite 10, or other transmitting node which provides communication services to subscribers, includes a phased array antenna which comprises at least two sections. These sections are folded during the launch of the satellite, and they are unfolded shortly after deployment in order to provide communications services to subscribers. Phased array antenna sections 20 and 25 are joined by hinge 15. Each antenna element, which comprises phased array antenna sections 20 and 25, can be of any type or construction, such as a dipole, monopole above a ground plane, patch, or any other conductive element which radiates or receives an electromagnetic wave as a function of an electrical current present on the surface of the element. Additionally, phased array antenna sections 20 and 25 can also be of the aperture type, such as a waveguide slot, horn, or any other type of nonconducting element which radiates or receives an electromagnetic wave as a function of an electric field present within an aperture.

In a preferred embodiment, satellite 10 comprises a digital beamformer. The use of a digital beamformer is preferred since it provides the capability to dynamically adjust the beam coefficients of the individual elements which comprise the phased array antenna section. Another advantage of the use of a digital beamformer within satellite 10 is the capability of generating a single antenna beam using all of the elements which comprise phased array antenna sections 20 and 25, or generating two separate antenna beams using the elements of each. Although the use of a digital beamformer is preferred, other equipment used to create and steer antenna beams can be used.

Transmit antenna beam 40 is generated by satellite 10 using phased array antenna section 20. Similarly, transmit antenna beam 50 is generated by satellite 10 using phased array antenna section 25. As shown in FIG. 1, transmit antenna beams 40 and 50 do not point in identical directions due to a misalignment of phased array antenna section 25. Therefore, each of phased array antenna sections 20 and 25 illuminates a different area on the surface of the earth. Under ideal circumstances, such as perfect alignment of both phased array antenna sections 20 and 25, each antenna section would illuminate an identical area. In this case, however, the misalignment of phased array antenna section 25 has caused the area of overlap to be reduced.

Figure 2:
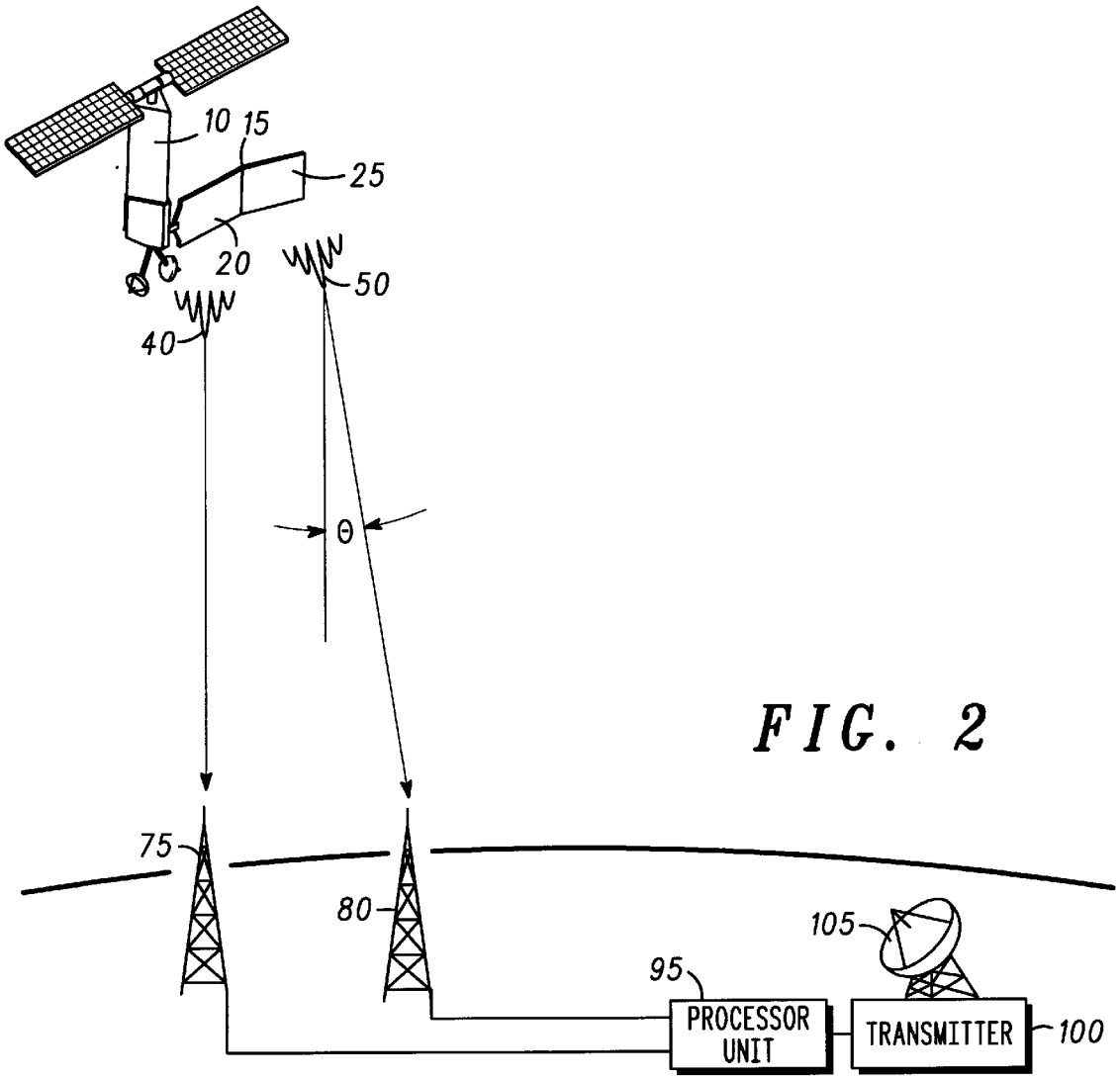
FIG. 2 illustrates a two-dimensional view of the measurement of a satellite antenna pattern using an earth-based receive antenna in accordance with a preferred embodiment of the invention.

FIG. 2 illustrates a two-dimensional view of the measurement of a satellite antenna pattern using an earth-based receive antenna in accordance with a preferred embodiment of the invention. (FIG. 2 contains the essential elements of FIG. 1 and has been included for clarity.) In FIG. 2, phased array antenna sections 20 and 25 are shown as being joined by hinge 15. Satellite 10 generates transmit antenna beams 40 and 50 using phased array antenna sections 20 and 25. Because of the misalignment of phased array antenna section 25, transmit antenna beam 50 does not point in the identical direction as transmit antenna beam 40. Although the misalignment of phased array antenna section 25 causes transmit antenna beam 50 to point in a different direction, compensation for this pointing error can be achieved within satellite 10.

As shown in FIG. 2, antennas 75 and 80 measure the energy from transmit antenna beams 40 and 50, respectively, and report this to processor unit 95. In a preferred embodiment, each of a plurality of receiving antennas, such as antennas 75 and 80, is positioned on the earth's surface at a fixed location so as to enable the measurement of antenna beams, such as transmit antenna beams 40 and 50, when other angles of misalignment are present. The use of a plurality of antennas separated by known distances allows a range of angles of misalignment to be measured quickly and require satellite 10 to transmit only over a very short duration.

In a preferred embodiment, processor unit 95 possesses interfaces to other antennas similar to antennas 75 and 80 which are not shown in FIG. 2. Processor unit 95 possesses the necessary hardware and software resources to calculate the angular offset of transmit antenna beam 50 from antenna beam 40. In the event that the maximum gain point of antenna beam 50 lies between antennas 75 and 80, processor unit 95 can make use of a geometric interpolation technique to determine the precise angular offset of the maximum gain point of transmit antenna beam 50. As shown in FIG. 2, determining the angle of misalignment of phased array antenna section 25 comprises solving for angle θ when the altitude to satellite 10 as well as the distance between antennas 75 and 80 are known.

The correction factor, which is determined by processor unit 95, can be in several forms. In a preferred embodiment, the correction factor is an angle θ for the maximum gain direction of antenna beam 50. However, the correction factor can be in the form of a distance or other equivalent quantity which can be used to derive the angle θ through the use of plane or solid trigonometry. In an alternative embodiment, the correction factor can be a plurality of beam coefficients which are applied to each element of phased array antenna section 25 provide the necessary correction of the maximum gain point of antenna beam 50.

The correction factor is conveyed from processor unit 95, through transmitter 100, to antenna 105. Antenna 105 transmits the correction factor to satellite 10. In response to receiving the correction factor, satellite 10 steers antenna beam 50 to the correct direction. In a preferred embodiment, the signal from antenna beam 50 is measured again by the ensemble of antennas 75 and 80 and processor unit 95 to verify that the correction factor has been properly applied to the elements which comprise phased array antenna section 25. This subsequent measurement can also be used to further refine the correction factor. Desirably, from this point on, the satellite 10 uses this correction factor when steering transmit antenna beam 50 as required to provide communication services to each earth-based subscriber.

In the event that the integrity of transmit antenna beams 40 or 50 become degraded due to the inactivation or breakage of some of the elements or the associated electronics which comprise phased array antenna section 20 or 25, a subsequent measurement can enable the beamformer of satellite 10 to apply a new correction factor in order to ensure the pointing accuracy of transmit antenna beams 40 or 50. In this manner, a periodic measurement, such as that described above, can enable the operator of satellite 10 to minimize the impact of failed antenna elements on the resulting antenna pattern.

In an alternative embodiment, the motion of satellite 10 relative to antennas 75 and 80 can be exploited to enable either of antennas 75 or 80 to report a time varying power level to processor unit 95 during the time that satellite 10 is in view. In the case of FIG. 2, with satellite 10 in motion relative to antenna 75, the power radiated from antenna beam 50 can be expected to lag behind that of antenna beam 40. By calculating the time varying power function, processor unit 95 can determine pointing angles of transmit antenna beams 40 and 50 as well as the shape of the main beam and sidelobes.

Figure 3:
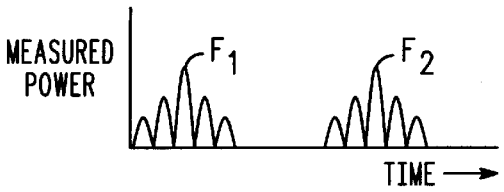
FIG. 3 illustrates a profile of a time varying transmit power pattern measured using a single antenna in accordance with a preferred embodiment of the invention.

FIG. 3 illustrates a profile of a time varying transmit power pattern measured using a single antenna in accordance with a preferred embodiment of the invention. In FIG. 3, transmit antenna beams 40 and 50 are operated at different frequencies or possess other distinguishing characteristics. This allows the simultaneous measurement of transmit antenna beams 40 and 50, including any substantial sidelobes. Transmit antenna beams 40 and 50 can make use of any other distinguishing characteristic such as a unique spreading code in a code division multiple access system. In any case, through the use of a distinguishing characteristic, processor unit 95 can simultaneously determine the two-dimensional transmitted power pattern of both transmit antenna beams 40 and 50. The resulting time varying pattern can be combined with other information such as the satellite velocity vector to arrive at a correction factor.

Figure 4:
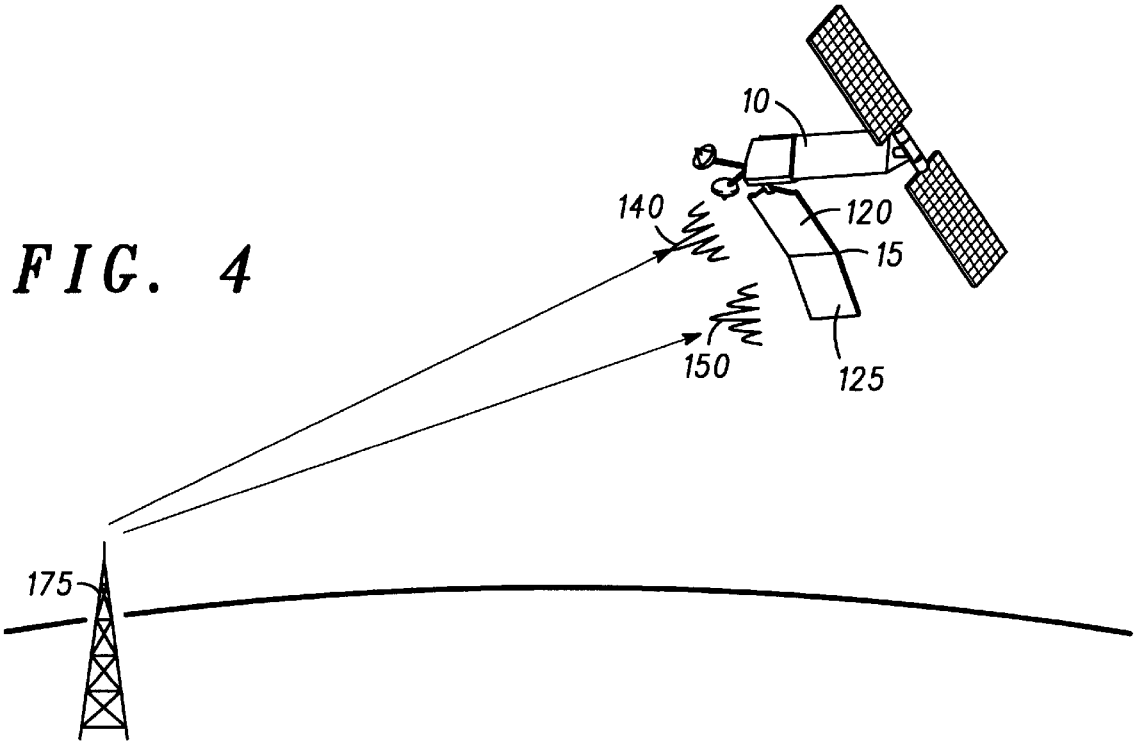
FIG. 4 illustrates the measurement of a satellite antenna pattern using an earth-based transmit antenna in accordance with an alternative embodiment of the invention.

FIG. 4 illustrates the measurement of a satellite antenna pattern using an earth-based transmit antenna in accordance with an alternative embodiment of the invention. In FIG. 4, a measurement is made using antenna 175 as a transmitter wherein the antenna transmits two signals simultaneously using a substantially different frequency or on channels which otherwise possess a distinguishing characteristic. This allows satellite 10, or other receiving node, to measure the power from transmit antenna 175 through receive antenna beam 140 and 150. In this case, due to the misalignment of phased array antenna section 125, the power received by phased array antenna section 125 is substantially less than that received by phased array antenna section 120. Thus, satellite 10 can steer receive antenna beam 52 until the received power is maximized. When the maximum power is received, the beamformer of satellite 10 can use this correction factor to modify the beam coefficients of the elements which comprise phased array antenna section 125.

Transmit antenna 175 can transmit over a very short duration or can transmit over a substantial portion of the duration that satellite 10 is in view. In the case of transmission over a very short duration, satellite 10 can determine a correction factor based on the power received through phased array antenna section 125 and compare this to the power received through phased array antenna section 120. Considering the difference in the two received power levels, satellite 10 can determine a correction factor to be applied to the beam coefficients for the elements which comprise phased array antenna section 125. Preferably, the process is repeated in order to confirm or to further refine the correction factor.

In the case of transmit antenna 175 transmitting a signal over a significant portion of the duration in which satellite 10 is in view, satellite 10 can measure the gain response of one or both of receive antenna beams 140 and 150 including any substantial sidelobes. Considering these measurements, satellite 10 can determine an appropriate correction factor for antenna beam 150 based on conventional power measurement techniques.

The use of a transmit antenna such as antenna 175 enables a correction factor to be generated using a minimum of ground equipment. Thus, a transmit antenna radiating a single continuous wave signal of sufficient power could be used to facilitate these measurements. The signal could be activated at all times, or only during specific testing intervals. Additionally, when satellite 10 possesses the capability to form several receive antenna beams simultaneously using other phased array antenna sections, the signal could be used to simultaneously calibrate these sections as well.

Figure 5:
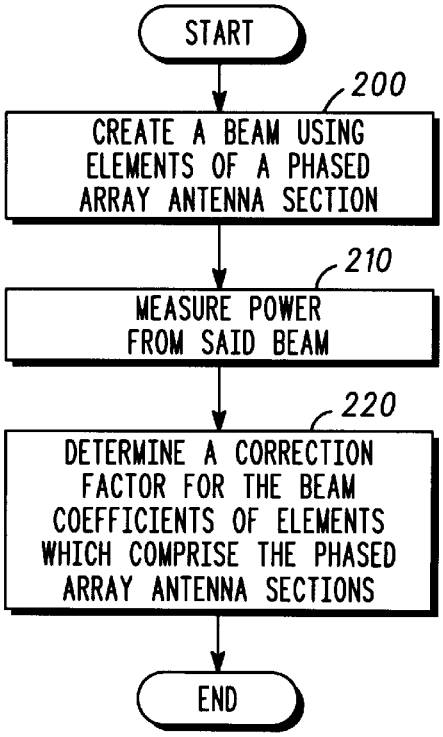
FIG. 5 illustrates a method for the measurement of a satellite antenna pattern using earth-based receive antennas in accordance with a preferred embodiment of the invention.

FIG. 5 illustrates a method for the measurement of a satellite antenna pattern using earth-based receive antennas in accordance with a preferred embodiment of the invention. Step 200 comprises creating a beam using elements of a phased array antenna section. Step 210 comprises the step of measuring power from said beam. Step 220 comprises the step of determining a correction factor for the beam coefficients of elements which comprise the phased array antenna section.

Figure 6:
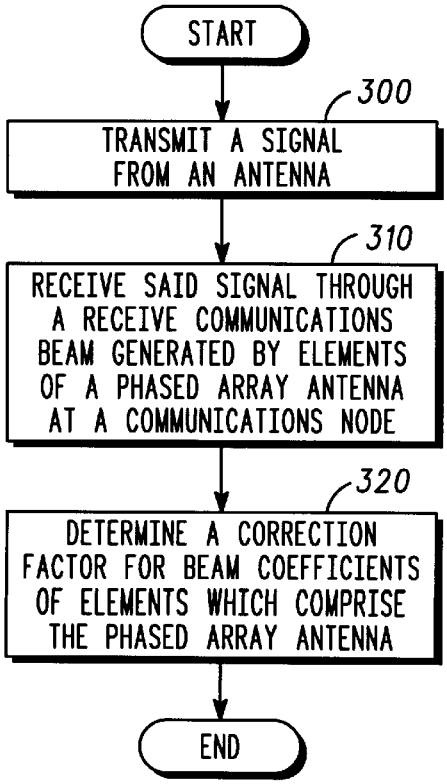
FIG. 6 illustrates a method for the measurement of a satellite antenna pattern using an earth-based transmit antenna in accordance with a preferred embodiment of the invention.

FIG. 6 illustrates a method for the measurement of a satellite antenna pattern using an earth-based transmit antenna in accordance with a preferred embodiment of the invention. Step 300 comprises transmitting a signal from an antenna. Step 310 comprises receiving said signal through a receive communications beam generated by elements of a phased array antenna at a communications node. Step 320 comprises the step of determining a correction factor for the beam coefficients of elements which comprise the phased array antenna.

A method and system for the calibration of sectionally assembled phased array antennas facilitates the low-cost correction in the pointing angle of a receive or transmit antenna beam created by a misalignment of antenna sections. This provides the ability to deploy large, sectionally assembled antenna systems without requiring precise control over the mechanical components which facilitate the unfolding of the antenna sections. The resulting antenna can therefore be lower in weight as well as fit into a smaller launch vehicle payload volume while maintaining the receive and transmit properties of a rigidly constructed, single section phased array antenna of comparable size. An additional benefit can be achieved from the periodic recalibration of a receive or transmit beam in order to optimize antenna performance after the loss of some of the elements which comprise the antenna.

Accordingly, it is intended by the appended claims to cover all modifications of the invention that fall within the true spirit and scope of the invention.

What is claimed is:

1. In an antenna comprising a plurality of phased array antenna sections, a method of determining a correction factor for beam coefficients used in at least one of said plurality of phased array antenna sections, comprising the steps of:

creating a beam using elements of said at least one of said plurality of phased array antenna sections;

measuring power from said beam from a remote location; and determining said correction factor for beam coefficients used in said at least one of said plurality of phased array antenna sections based on said power.

2. The method claimed in claim 1, wherein said method further comprises repeating the measuring and determining steps.

3. The method claimed in claim 1, wherein said method occurs in a satellite that provides communication services to an earth-based subscriber.

4. The method claimed in claim 1, wherein said creating step occurs using a digital beamformer.

5. The method claimed in claim 1, wherein said measuring step occurs on the earth's surface using an antenna positioned at a fixed location.

6. The method claimed in claim 1, wherein said measuring step occurs using a plurality of receiving antennas located substantially proximate to each other.

7. The method claimed in claim 1, wherein said measuring step occurs over a very short duration.

8. The method claimed in claim 1, wherein said measuring step occurs by measuring power over a substantial portion of a duration that a satellite is in view.

9. In an antenna comprising a plurality of phased array antenna sections, a method of determining a correction factor for beam coefficients used in at least one of said plurality of phased array antenna sections, comprising the steps of:

transmitting a signal from an antenna;

receiving at a communications node said signal through a receive communications beam, said receive communications beam being generated by said at least one of said plurality of phased array antenna sections;

measuring the power of said signal from a remote location; and determining a correction factor for beam coefficients of elements which comprise said at least one of said plurality of phased array antenna sections based on said power.

10. The method claimed in claim 9, wherein said method further comprises repeating the receiving and determining steps.

11. The method claimed in claim 9, wherein said determining step is performed in a satellite that provides communication services to an earth-based subscriber.

12. The method claimed in claim 9, wherein said receiving step occurs using a digital beamformer.

13. The method claimed in claim 9, wherein said transmitting step occurs on the earth's surface using an antenna positioned at a fixed location.

14. The method claimed in claim 9, wherein said measuring step is performed using a plurality of antennas located substantially proximate to each other.

15. The method claimed in claim 9, wherein said measuring step occurs by measuring said power over a very short duration.

16. The method claimed in claim 9, wherein said transmitting step occurs by measuring power over a substantial portion of a duration that a satellite is in view.

17. A transmitting node for determining a correction factor for beam coefficients used in a phased array antenna, said phased array antenna including a plurality of sections, said transmitting node comprising:

an antenna which receives a signal from at least one of said plurality of sections of said phased array antenna, said phased array antenna being at a remote location from said antenna;

a processor which calculates a correction factor for beam coefficients of at least one of said plurality of sections of said phased array antenna, said correction factor being based on the power of said signal; and a transmitter which transmits said correction factor from said transmitting node.

18. The transmitting node of claim 17, wherein said transmitting node comprises a satellite.

19. The transmitting node of claim 17, wherein said transmitting node comprises a digital beamformer.

20. The transmitting node of claim 17, wherein said transmitting node is positioned at a fixed location.

21. A system for determining a correction factor for beam coefficients used in a phased array antenna, said phased array antenna including a plurality of sections, said system comprising:

a transmitter which transmits a signal to a receiving node;

a receiving node which comprises said phased array antenna, said receiving node being used to measure the power of said signal from a remote location; and a processor which calculates said correction factor for beam coefficients used in at least one of said sections of said phased array antenna.

22. The system of claim 21, wherein said receiving node comprises a satellite.

23. The system of claim 21, wherein said receiving node comprises a digital beamformer.

* * * * *